United States Patent [19]

Kimmel

[11] 4,005,853

[45] Feb. 1, 1977

[54] MIXING PROCESS AND AN ARRANGEMENT FOR CARRYING OUT THE PROCESS

[75] Inventor: Hans Kimmel, Detmold, Germany

[73] Assignee: Gunther Papenmeier KG, Maschinen-und Apparatebau, Detmold, Germany

[22] Filed: Dec. 23, 1974

[21] Appl. No.: 535,368

[30] Foreign Application Priority Data

Dec. 28, 1973 Germany ..... 2364978

[52] U.S. Cl. ..... 259/3; 259/84

[51] Int. Cl.[2] ..... B01F 9/08

[58] Field of Search ..... 259/104, 3, 82, 83, 259/84, 85, 15, 31, 32, 33, 58

[56] References Cited

UNITED STATES PATENTS

| | | | |
|---|---|---|---|
| 105,175 | 7/1870 | Codd | 259/84 |
| 336,079 | 2/1886 | Bassett | 259/84 |
| 2,845,254 | 7/1958 | Howden | 259/3 |
| 2,905,450 | 9/1959 | Poure | 259/84 |
| 2,961,224 | 11/1960 | Wright | 259/104 |
| 3,090,605 | 5/1963 | Copeland et al. | 259/104 |
| 3,281,126 | 10/1966 | Maxon | 259/178 R |

*Primary Examiner*—Robert W. Jenkins

*Attorney, Agent, or Firm*—Strauch, Nolan, Neale, Nies & Kurz

[57] ABSTRACT

Apparatus and a process for mixing in a continuous manner viscous, gel-like, paste-like, fluid, or other materials by means of a mixing-container which continually revolves and which has mixing elements arranged therein. The mixer revolves at such a speed that the mixing-material will lie along at least one portion of the circumference of the mixing-container. The mixing elements are independently driven screw conveyors or adjustable deflection blades which cause the material within the mixing container to be moved back and forth axially of the rotating mixing container and progressing step-wise from the inlet end to the outlet end of the mixing container.

3 Claims, 6 Drawing Figures

MIXING PROCESS AND AN ARRANGEMENT FOR CARRYING OUT THE PROCESS

Figure 1:
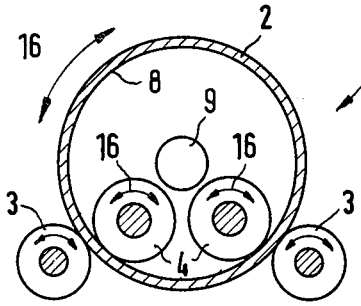

In the German Patent No. 561,266 a mixer is shown in which a mixing-drum revolves about a horizontal axis and in which the mixing-material is fed to the drum from an opening located at the side of the axis. The mixing-drum revolves at such a speed that the mixing material will lie along the inner wall of the mixing-drum. The mixing-material exits from the drum at the upper point of the mixing material trajectory through a by-pass vane and is led away by means of a conveyor belt. The disadvantage of this prior art mixer is that the gell-time of the mixing-material in the mixing-chamber cannot be adjusted.

In the German Offenlegungsschrift No. 1,607,775, a mixing-machine with a cylindrical mixing-drum is shown which likewise allows for a continuous operation. The mixing-drum is, however, fixed and cannot revolve. There are included two screw conveyors which impart to the mixing-material two different components of movement. One of the spirals forces the mixing-material in a transverse direction, the other tends to feed the material in the opposite direction. The component in the transverse direction is selected to be larger than that which forces the material in the opposite direction. The mixing-material will be forced, therefore, in a back-and-forth movement through the mixing-drum. An increase in the spiral revolutions will cause increase in the flow rate of the material; however, a simultaneous influence in the amount of mixing cannot be achieved by means of this increase in the revolution speed.

The instant invention has an object, a process as well as an arrangement for carrying out said process whereby the mixing of viscous, gel-like, paste-like, fluid, or other materials can be adjusted independently of the flow rate of the material through the mixer. This is achieved without the necessity of a complete change of the basic construction of the mixer.

This object is achieved in that the mixed material is moved by means of mixing-elements in a transverse direction and in an opposite direction in such a manner that the component of movement in the transverse direction is larger than that of the opposite direction. The container revolutions and the components of movement caused by the mixing-elements are independently adjustable so that one achieves an independent influencing of the flow rate and the amount of mixing.

The mixing container revolves at such a speed that the mixing-material lies along the container inner wall. It is particularly advantageous if the component of movement which is caused by the mixing-elements in the mixing material are adjustable independently of each other. This adjustment can be obtained, e.g., through the use of deflection blades, the placement angle of the blades being adjustable. It is also possible to use as mixing-elements revolving spirals as it is shown, e.g., in the above mentioned German Offenlegungsschrift No. 1,607,775. By means of the independent adjustability of the speed of revolution of the spirals, one can cause a back-and-forth movement which will lead the mixing-material from the input opening to the output opening of the mixing-container. By means of the adjustment of these speeds of revolution, the amount of mixing can be adjusted and, by means of the adjustment of the speed of revolution of the mixing-container, the flow rate of the material through the container can be influenced. Experience has taught that, with a given size of the container, one can achieve, solely by means of changing the speeds of revolution of the container and the screw conveyors, different flow rates and amount of mixing.

The invention is more particularly described with reference to the drawings in which two embodiments are shown.

Figure 3:
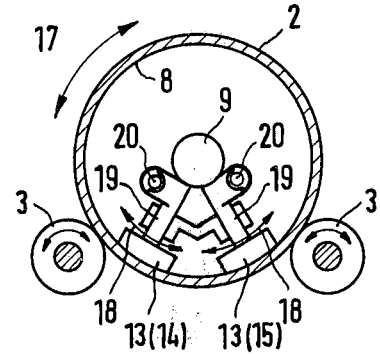
Figure 2:
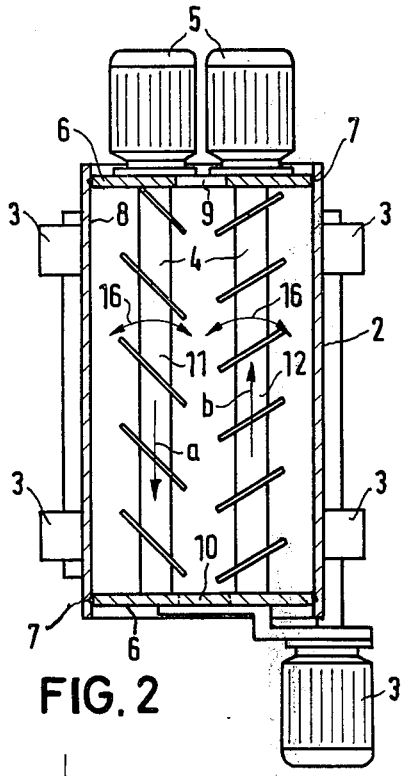
Figure 4:
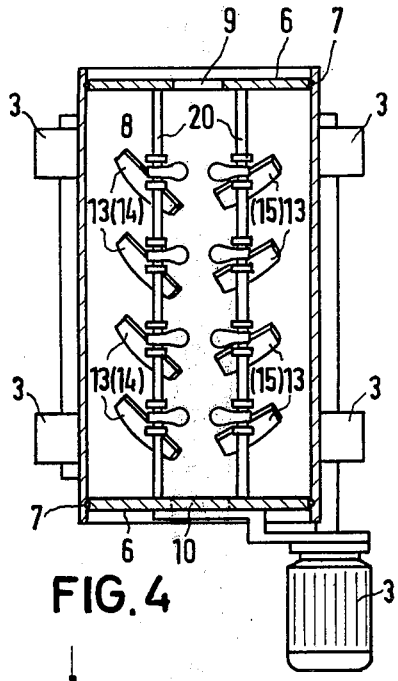
Figure 5:
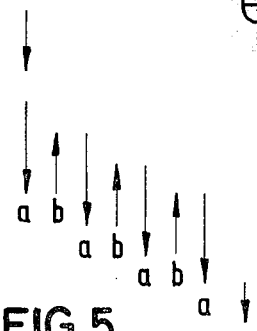
Figure 6:
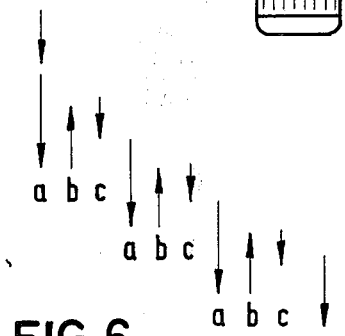

FIG. 1 — A schematic representation of a portion of the mixing-container with a revolving spiral conveyor shown in cross-section FIG. 2 — A schematic representation of a longitudinal cross-sectional view of the FIG. 1 arrangement FIG. 3 — A schematic representation of a portion of a mixing container with oblique deflection blade shown in cross-section FIG. 4 — A longitudinal cross-sectional view of the FIG. 3 arrangement FIG. 5 — A schematic representation of the movement of the mixed material in a back-and-forth movement which can be achieved by means of using two screw conveyors or two deflection blade arrangements working in conjunction FIG. 6 — A schematic representation of the mixing-material movement which is achieved by using three spiral conveyors or three deflection blade arrangements working in conjunction.

The mixer shown in FIGS. 1 through 4 includes, in its basic construction, a revolving mixing-container 2 with appropriate driving and support rollers 3. The mixing container 2 can be cylindrical or cone-shaped. In the Figures, a container is shown which has a cylindrical form. Mixing-elements are arranged within the mixing-container; these elements do not revolve with the container but rather are fixedly mounted.

The mixers shown in FIGS. 1 through 4 have mixing drums which revolve about a horizontal axis. It is however possible to use containers which rotate about a vertical or oblique axis.

The mixing-elements comprise, as shown in FIGS. 1 and 2, two conveyors 4. Each screw conveyor has an independent driving arrangement 5, which is, preferably, an electric motor. These driving arrangements 5 and the screw conveyors 4 are fixed to a front wall 6. Between the front walls 6 and the container walls 8 are appropriate gaskets which allow a rotational movement of the container walls 8 with respect to the container front walls 6. A mixing-material input opening 9 is located in one of the front walls 6 and an output opening 16 is located in the opposite front wall.

The mixing container 2 spins with such a speed that the mixing material lies along at least a portion of the circumference of the container wall 8. The material reaches the wall at a location near to the upper point of trajectory and then falls in a curtain-like manner. The speed of revolution of the container can be so large that the mixing-material completely coats the wall 8. The mixing-elements in the form of screw conveyors 4 force the mixing-material through the container 2 in such a manner that the material affected by screw 11 tends to move toward output opening 10, while the material influenced by screw 12 tends to move in the opposite direction. The speed of revolution or the indination of the screws is selected in such a manner that the component of movement in the direction of the output opening 10 is larger than the component of movement in direction of the input opening 9. The speed of revolution of the screw conveyors can be so adjusted that there will be absolutely no resulting movement in the direction of output 10. By means of appropriate adjustment of the speed of revolution, one can also take into account different values of the screw pitch. FIG. 2 shows screws with different pitches.

The mixer shown in FIG. 3 and 4 utilizes, instead of the screw conveyors, two sets of adjustable deflection blades 13 as mixing-elements. The blades 13 are arranged in an oblique manner in order to have an influence on the movement of the material and are connected, by means of cross-piece 19, with an adjustment arrangement 20. By means of the adjustment arrangement 20, one can independently adjust the inclination of each set of deflection blades 13 which are successively arranged in series. Therefore, it is possible to place the blades with different inclinations so that, e.g., all the material which is on the inner wall of the container will be forced from the input opening 9 to the output opening 10. Thus, the material receives, by means of an appropriate adjustment of the inclination of the blades 13, a back-and-forth impulse on its way from the input opening 9 to the output opening 10. The push in the direction of the output opening 10 is provided by the blades 14 while that in the opposite direction is provided by blades 15.

In FIGS. 1 and 2, arrow 16 shows the direction of revolution of the mixing-container 2 and the screw conveyor 4. In FIGS. 3 and 4, the direction of revolution of the container is shown by arrow 17, while arrow 18 shows the direction of adjustment of the deflection blades 13.

It is particularly advantageous, in using the device according to this invention, if the screw conveyors or deflection blades are utilized in pairs.

FIG. 5 shows a diagram of the advance movements in a back-and-forth manner, which is achieved through the use of a pair of screw conveyors or deflection blades. The first screw conveyor or the first series of the deflection blades cause an advance in the output direction shown by *a*, while the second screw or second series of blades causes an advance in the direction of the input opening shown by *b*. In this way the mixing material wanders in a back-and-forth manner gradually from the input opening to the output opening of the mixing-container. This back-and-forth movement causes a thorough mixing of the mixing-material.

FIG. 6 shows a diagram of the advance movement achieved through the use of three screw conveyors with different speeds of revolution or three series of deflection blades which are independently adjustable.

The first screw or series or deflection blades causes an advance in the output opening direction *a*, the second screw or series of blades causes an advance *b* in the opposite direction, while the third screw or series causes another advance in the output direction *c*.

As one can see from the afore-going description, one can achieve, by changing the speed of revolution of the mixing-container, a flow rate which is independently adjustable from the amount of mixing, the amount of mixing being independently adjustable by means of varying speed or pitch of the screw conveyors or by varying the inclination of the deflection blades.

What is claimed is:

1. A process for mixing comprising the steps of: rotating a mixing container about its axis while passing material to be mixed therethrough, said container being rotated at such a speed so that the mix material lies along at least a portion of the container wall; moving the material to be mixed in a back-and-forth movement with its movement in a direction toward the output end of the container being greater than that in the other direction so that the material progresses during mixing toward and out of the output end of the container; said material moving step comprising the steps of rotating at least two screw conveyors at speeds independent of each other and with one conveyor acting on the material to move it in the other of said directions; said speed of revolution of said container being independent of the speed of revolution of said screw containers, whereby the adjustment of the speeds of revolution of said rotating container and of said screw conveyors influences the absolute values of the flow rate from the input end to the output end and the amount of mixing of the material as well as their relationship with respect to each other during passage through the container.

2. A process for mixing comprising the steps of:

a. rotating a mixing container about its axis at such a speed so that the mix material lies along at least a portion of the container wall;

b. moving the material to be mixed in a back-and-forth movement with the movement in one direction being greater than that in the other direction, said moving being effected by at least two sets of deflection blades, the degree of movement in said directions being determined by the degree of inclination of said blades, said degree of inclination being independently adjustable; whereby the adjustment of the speed of revolution of said rotating container and the degree of inclination of said blades influences the absolute values of the flow rate and the amount of mixing of the material as well as their relationship with respect to each other.

3. A process for continuously mixing materials using a mixing container rotatable about an axis, with an input opening at one end and an output opening at the other end and at least two mixing element means spaced apart and located within the mixing container comprising the steps of: rotating the mixing container about its axis at such a speed so that material introduced through the input opening and being mixed lies along at least a portion of the container wall; moving the material to be mixed in a back-and-forth movement with the movement in one direction being greater than that in the other direction; said material moving step comprising the steps of imparting axial movement to the material being rotated by the mixing container by both of said two mixing element means, independently of each other and in different directions within the container whereby the adjustment of the speed of revolution of said rotating container and adjustment of the mixing element means to vary the axial flow movement imparted to the material influences the absolute values of the flow rate from the input opening to the output opening and the amount of mixing of the material during its passage through the mixing container.

* * * * *